US010807360B2

(12) United States Patent
Anderson et al.

(10) Patent No.: US 10,807,360 B2
(45) Date of Patent: Oct. 20, 2020

(54) FLUID EJECTION DIE INCLUDING SIGNAL CONTROL LOGIC

(71) Applicant: HEWLETT-PACKARD DEVELOPMENT COMPANY, L.P., Spring, TX (US)

(72) Inventors: Daryl E Anderson, Corvallis, OR (US); Eric Martin, Corvallis, OR (US); James Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/331,862

(22) PCT Filed: Dec. 14, 2016

(86) PCT No.: PCT/US2016/066707

§ 371 (c)(1),
(2) Date: Mar. 8, 2019

(87) PCT Pub. No.: WO2018/111265

PCT Pub. Date: Jun. 21, 2018

(65) Prior Publication Data

US 2019/0375206 A1 Dec. 12, 2019

(51) Int. Cl.

| | |
|---|---|
| ***B41J 2/045*** | (2006.01) |
| ***B41J 2/14*** | (2006.01) |
| ***B41J 2/125*** | (2006.01) |

(52) U.S. Cl.

CPC ..... *B41J 2/04541* (2013.01); *B41J 2/04543* (2013.01); *B41J 2/125* (2013.01); *B41J 2/14* (2013.01); *B41J 2002/14354* (2013.01)

(58) Field of Classification Search

CPC .... B41J 2/04541; B41J 2/04543; B41J 2/125; B41J 2/14

See application file for complete search history.

(56) References Cited

U.S. PATENT DOCUMENTS

| | | | |
|---|---|---|---|
| 4,377,972 | A | 3/1983 | O'Neil |
| 4,907,013 | A | 3/1990 | Hubbard et al. |
| 6,705,694 | B1 | 3/2004 | Barbour et al. |
| 6,905,185 | B2 | 6/2005 | Nakayama |
| 7,549,715 | B2 | 6/2009 | Walmsley |

(Continued)

FOREIGN PATENT DOCUMENTS

| | | |
|---|---|---|
| CN | 101291812 | 10/2008 |
| CN | 103029438 | 4/2013 |

(Continued)

OTHER PUBLICATIONS

Webpage. Kyocera. Controlling the TPH, Feb. 1, 2001, <http://global.kyocera.com/prdct/printing-devices/thermal-printheads/tec/controlling.html >.

*Primary Examiner* — Jason S Uhlenhake
(74) *Attorney, Agent, or Firm* — Dierke & Kavanuagh PC

(57) ABSTRACT

Examples include a fluid ejection die. Examples comprise an array of nozzles, where each respective nozzle includes a respective fluid ejector. Examples further include at least one die sensor. Furthermore, the examples include signal control logic to suppress transmission of a first set of signals for the fluid ejection die during sensing of die characteristics with the at least one die sensor.

14 Claims, 6 Drawing Sheets

(56) References Cited

U.S. PATENT DOCUMENTS

| | | | | |
|---|---|---|---|---|
| 2007/0070104 | A1* | 3/2007 | Park | B41J 2/04541 347/12 |
| 2008/0079764 | A1* | 4/2008 | Haflinger | B41J 2/0451 347/19 |
| 2013/0083107 | A1 | 4/2013 | Nishikawa et al. | |
| 2015/0352841 | A1 | 12/2015 | Horie | |
| 2016/0279932 | A1* | 9/2016 | Kamiyanagi | B41J 2/04588 |

FOREIGN PATENT DOCUMENTS

| | | | |
|---|---|---|---|
| EP | 1128324 | | 8/2001 |
| EP | 3228458 | A1 | 10/2017 |
| JP | 2010120181 | A | 6/2010 |
| JP | 2015051586 | A | 3/2015 |
| WO | WO-2005105445 | | 11/2005 |
| WO | WO-2007061138 | | 5/2007 |
| WO | WO-2005105455 | | 11/2015 |

* cited by examiner

FLUID EJECTION DIE INCLUDING SIGNAL CONTROL LOGIC

BACKGROUND

Fluid ejection dies may eject fluid drops via nozzles thereof. Some fluid ejection dies may include fluid ejectors that may be actuated to thereby cause ejection of drops of fluid through nozzle orifices of the nozzles. Some example fluid ejection dies may be printheads, where the fluid ejected may correspond to ink.

DRAWINGS

FIGS. 1A-B are block diagrams that illustrate some components of an example fluid ejection die.

Figure 1A:
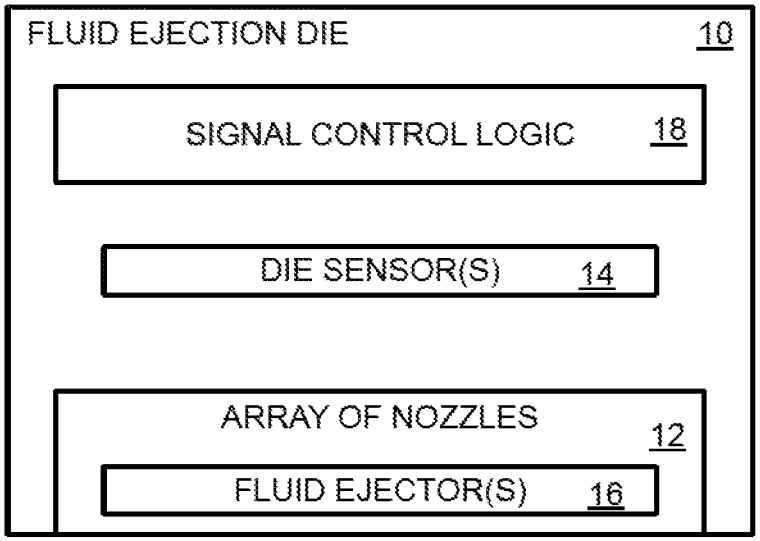

Throughout the drawings, identical reference numbers designate similar, but not necessarily identical, elements. The figures are not necessarily to scale, and the size of some parts may be exaggerated to more dearly illustrate the example shown. Moreover the drawings provide examples and/or implementations consistent with the description; however, the description is not limited to the examples and/or implementations provided in the drawings.

DESCRIPTION

Examples of fluid ejection dies may comprise a plurality of ejection nozzles that may be arranged in an array, where such plurality of nozzles may be referred to as an array of nozzles. In some examples, each nozzle may comprise a fluid chamber, a nozzle orifice, and a fluid ejector. In some examples, the fluid ejection die may further comprise at least one die sensor, where the at least one die sensor is to sense at least one die characteristic associated with the fluid ejection die. In some examples, the at least one die sensor may comprise a respective nozzle sensor for each respective nozzle of the array of nozzles. In such examples the fluid ejector of a nozzle may be actuated to thereby cause displacement of a drop of fluid in the fluid chamber. Some examples of types of fluid ejectors implemented in fluid ejection devices include thermal ejectors, piezoelectric ejectors, and/or other such ejectors that may cause fluid to be ejected/dispensed from a nozzle orifice. The displaced fluid may eject through the nozzle orifice.

Example fluid ejection dies may actuate a fluid ejector by generating an ejection pulse. To cause fluid ejection of an array of nozzles, a plurality of ejection pulses may be generated based at least in part on received signals. In some examples, such signals may include ejection data for each nozzle (which may be referred to as array ejection data) and an ejection dock. Array ejection data may correspond to a given time slice in which some nozzles are to be ejected, where array ejection data for a given time slice may be referred to as an array ejection data packet, an array ejection data group, or a fire pulse group. By generating array ejection data groups for respective time slices and generating ejection pulses based at least in part thereon, repeated and selective ejection of fluid drops may be performed by a fluid ejection die. Accordingly, examples of fluid ejection dies may be described as ejecting fluid drops during operation.

In some examples, the at least one die sensor may be actuated to sense at least one die characteristic corresponding to the fluid ejection die. In examples in which the at least one die sensor comprises a nozzle sensor for each nozzle, each nozzle sensor of each nozzle may be actuated to sense a nozzle characteristic corresponding to the nozzle. For example, a sense circuit connected to the nozzle sensor may transmit and receive an electrical signal via the nozzle sensor. Characteristics of the received electrical signal may correspond to die characteristics and/or nozzle characteristics. Examples of die and/or nozzle characteristics may include impedance, capacitance, pressure, temperature, strain, and/or other such characteristics. As will be appreciated, based on the die and/or nozzle characteristics sensed via a die and/or nozzle sensor, a status of a fluid ejection die and/or a nozzle thereof may be evaluated.

However, in some examples including die and/or nozzle sensors, signals associated with operation of the fluid ejection die (such as array ejection data and an ejection clock) may cause interference for signals associated with sensing die and/or nozzle characteristics. Accordingly, die and/or nozzle characteristic sensing may be inaccurate due to such interference. In addition, sensors and sense circuitry may be susceptible to damage if signal interference is included in a sensing signal. Example fluid ejection dies described herein may comprise signal control logic to suppress transmission of a first set of signals for the fluid ejection die during sensing of die and/or nozzle characteristics with the die and/or nozzle sensors. In some examples, the first set of signals may include an ejection clock and array ejection data. It will be appreciated that in other examples, the first set of signals may include additional signals that may be transmitted on the fluid ejection die during operation thereof which may cause interference during sensing of die and/or nozzle characteristics.

Figure 1B:
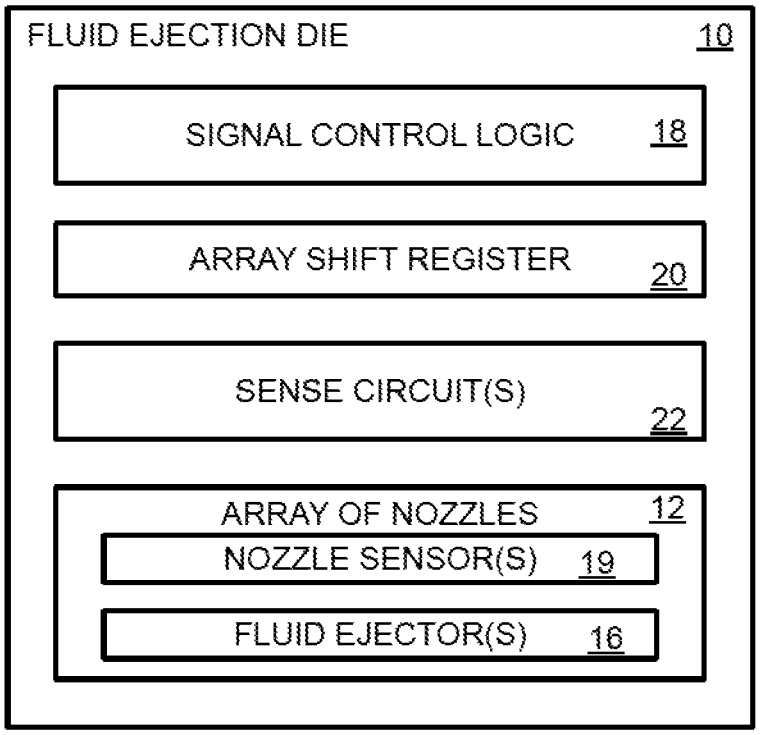

Turning now to the figures, and particularly to FIGS. 1A-B, these figures provide block diagrams that illustrates some components of an example fluid ejection die 10. In this example, the fluid ejection die 10 includes an array of nozzles 12 and at least one die sensor 14. In addition, each respective nozzle of the array of nozzles 12 comprises a respective fluid ejector 16. Furthermore, as shown in this example, the fluid ejection die 10 includes signal control logic 18. In examples similar to the example fluid ejection die 10, the signal control logic 18 may suppress transmission of a first set of signals for the fluid ejection die 10 during sensing of die characteristics with the at least one die sensor 14 of the fluid ejection die 10. Furthermore, during generation of ejection pulses for the array of nozzles 12 (such that fluid drops may be ejected via the nozzles), the signal control logic 18 may pass the first set of signals such that ejection pulses may be generated based thereon.

As used herein, suppressing transmission of signals may correspond to: preventing transmission of such signals; attenuating such signals; and/or filtering at least some frequencies of such signals. In some examples, suppressing of signals may comprise disconnecting at least one communication path corresponding to such signals. In other examples, suppressing of signals may comprise applying signal filtering for at least one communication path corresponding to such signals. In some examples, suppressing of signals may comprise attenuating such signals. In some examples, passing of signals may comprise connecting/reconnecting at least one communication path corresponding to such signals. In some examples, passing of signals may comprise increasing a transmission bandwidth corresponding to such signals. In some examples, passing of signals may comprise amplifying such signals.

In FIG. 1B, the at least one die sensor comprises a respective nozzle sensor 19 for each respective nozzle of the array of nozzles 12. Furthermore, the fluid ejection die 10 further comprises an array shift register 20 that may be coupled to the nozzles of the array of nozzles 12. In such examples, the array shift register 20 may generate ejection pulses for the fluid ejectors 16 to thereby cause the nozzles of the array 12 to eject drops of fluid. In some examples, the array shift register 20 may receive array ejection data for the array of nozzles and an ejection dock. In such examples, the array ejection data indicates whether each nozzle of the array of nozzles 12 is to eject a drop of fluid. Based on the array ejection data and the ejection dock, the array shift register 20 may generate ejection pulses for the nozzles of the array of nozzles to eject drops.

Furthermore, the fluid ejection die 10 of FIG. 1B includes sense circuits 22. In particular, the fluid ejection die 10 may include a respective sense circuit connected to the respective nozzle sensor 14 of each respective nozzle of the array of nozzles 12. As will be appreciated, in some examples, sense circuits 22 may be connected to die sensors, such as the die sensors 14 of FIG. 1A. As discussed above, a respective sense circuit may sense nozzle characteristics of the respective nozzle. For example, a sense circuit may sense an impedance corresponding to a nozzle. As another example, a sense circuit may sense a capacitance corresponding to a nozzle. In another example, a sense circuit may sense a temperature corresponding to a nozzle. Furthermore, in some examples, a sense circuit may sense, for at least one nozzle, at least one of an impedance, a capacitance, a temperature, a strain, or any combination thereof. In some examples, each respective sense circuit may be operated after fluid ejection via the respective nozzle to evaluate a status of the respective nozzle after ejection of fluid.

Figure 2:
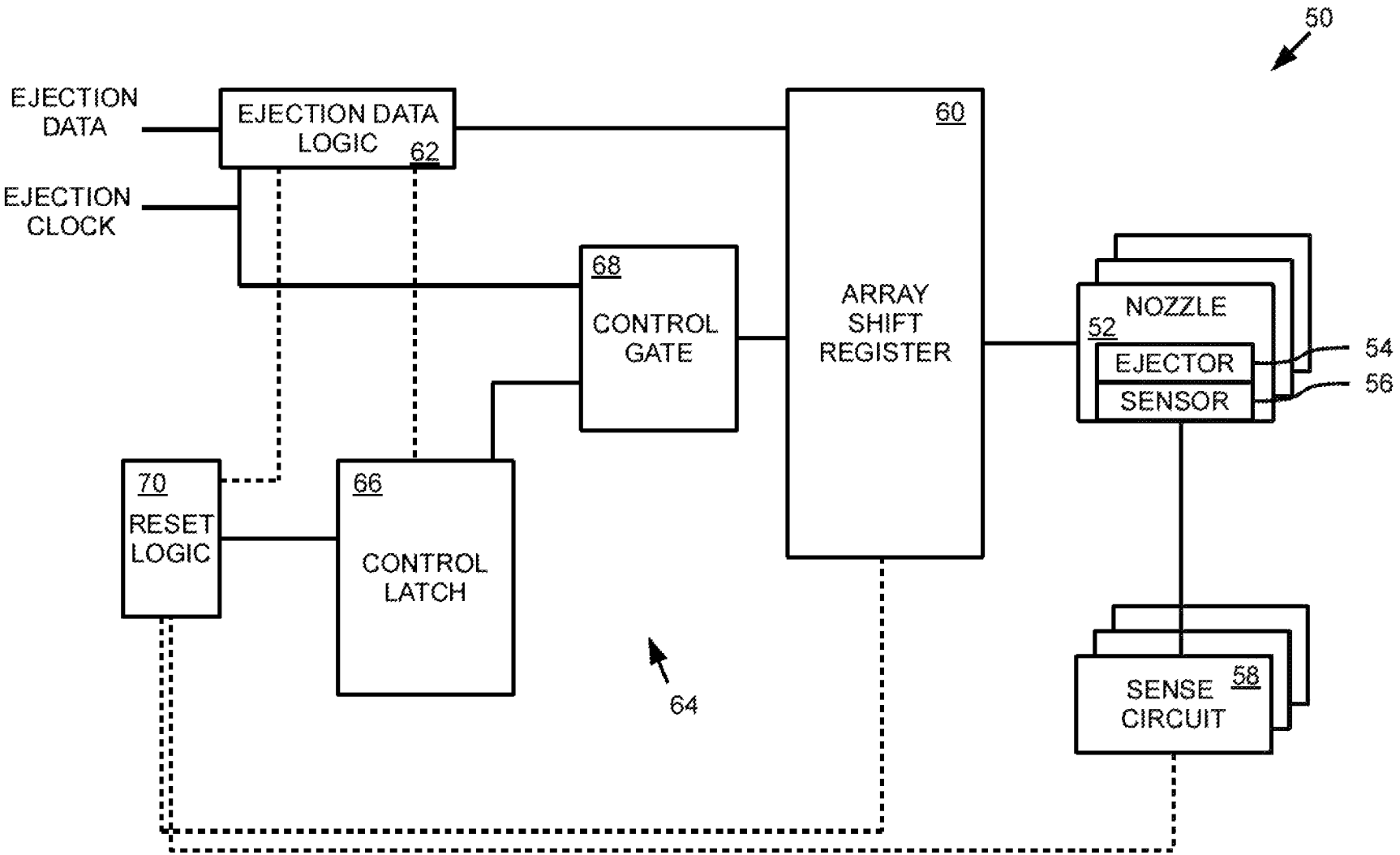
FIG. 2 is a block diagram that illustrates some components of an example fluid ejection die.

FIG. 2 provides a block diagram that illustrates some components of an example fluid ejection die 50. In this example, the fluid ejection die comprises a plurality of nozzles 52, which may be referred to as an array of nozzles. Each nozzle 52 includes a fluid ejector 54 with which to cause ejection of fluid drops via a nozzle orifice of the nozzle 52. Furthermore, each nozzle includes a nozzle sensor 56 that is connected to a sense circuit 58. As discussed in previous examples, the fluid ejection die 50 further includes an array shift register 60 connected to the nozzles 52. The fluid ejection die 50 includes ejection data logic 62 connected to the array shift register 60. The ejection data logic 62 may receive ejection data for the fluid ejection die 50 and an ejection clock, and the ejection data logic 62 may generate array ejection data corresponding to the nozzles 52 of the fluid ejection die 50 based on the ejection data and the ejection dock. In particular, the ejection data logic 62 may generate and transmit array ejection data groups to the array shift register 60. As will be appreciated, the array ejection data groups may indicate which nozzles 52 of the array of nozzles to be fired for a respective ejection operation, where each ejection operation is timed according to the ejection clock. Upon receiving the array ejection data groups, the array shift register 60 may generate ejection pulses for nozzles 52 of the plurality of nozzles based at least in part on the array ejection data and the ejection clock.

In some examples, the ejection data logic 62 may comprise at least one controller, where the controller may generate the ejection dock. As described herein, a controller may be any combination of hardware and programming to implement the functionalities described with respect to a controller and/or a method. For example, the ejection data logic 62 may comprise a controller in the form of application-specific integrated circuit or other such configurations of logical components for data processing.

As described in previous examples, the fluid ejection die 50 further includes signal control logic 64 to suppress transmission of a first set of signals for the fluid ejection die during sensing of nozzle characteristics with the nozzle sensors 56 and sense circuits 58. In this example, the signal control logic 64 comprises a control latch 66, a control gate 68, and reset logic 70. As shown, the control latch 66 is coupled to the ejection data logic 62 such that the control latch may detect transmission of array ejection data groups from the ejection data logic 62 to the array shift register 60. The control gate 68 may be connected to the ejection dock, and the control gate 68 may be connected between the control latch 66 and the array shift register 60 such that the control gate may pass the ejection dock to the array shift register 68 responsive to the detection of transmission of array ejection data by the control latch 66.

As will be appreciated, when transmission of array ejection data 66 is not detected, the control gate 68 may suppress transmission of the ejection clock to the array shift register 60. Therefore, in this example, the first set of signals that may be suppressed or passed for the fluid ejection die may include the ejection dock. Furthermore, by passing the ejection clock to the array shift register based at least in part on detection of transmission of array ejection data, it will be appreciated that the signal control logic 64 therefore suppresses transmission of the ejection clock when the fluid ejection die 50 is not operating to eject fluid. In turn, the signal control logic 64 suppresses transmission of the ejection clock when the sense circuits 58 and nozzle sensors 56 are operating to sense nozzle characteristics of the nozzles 52. In some examples, the control gate may include a logical AND gate or other such similar logic components.

In the example of FIG. 2, the reset logic 70 may be connected to the array shift register 60 and the control latch 66. In some examples, the reset logic 70 may be connected to the sense circuits 58. In other examples, the reset logic 70 may be connected to the ejection data logic 62. In this example, the reset logic 70 may detect completion of fluid ejection for respective array ejection data, and the reset logic 70 may cause the control latch 66 to reset responsive to detection of completion of ejection pulse generation by the array shift register 60 and the corresponding fluid ejection by the nozzles 52. Upon resetting, the control latch 66 may therefore cause suppression of transmission of the ejection clock to the array shift register 60. In some examples, the reset logic may comprise a logical XOR (exclusive OR) gate, a logical OR gate, a NAND (not AND) gate, or other similar logic components.

Figure 3:
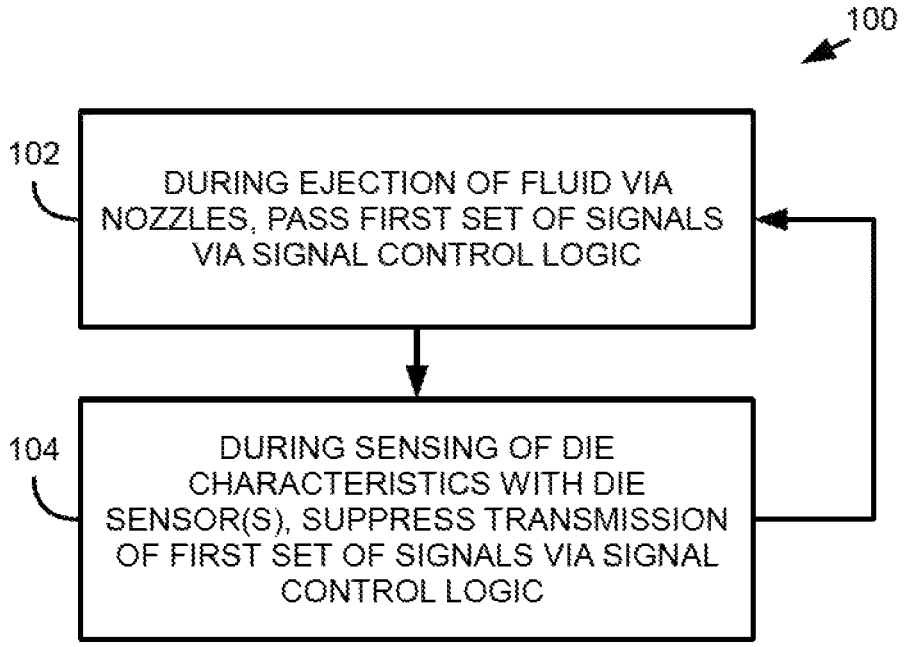
FIG. 3 is a flowchart that illustrates an example sequence of operations that may be performed by an example fluid ejection die.

FIG. 3 provides a flowchart 100 that illustrates an example sequence of operations that may be performed by signal control logic of an example fluid ejection die. During ejection of fluid via nozzles of the fluid ejection die, examples may pass a first set of signals via the signal control logic (block 102). During sensing of die characteristics with at least one die sensor, examples may suppress transmission of the first set of signals via the signal control logic (block 104). In some examples, the first set of signals may comprise an ejection dock, array ejection data, and/or other such digital signals of the fluid ejection die that may create interference when die nozzle characteristics with the die sensors thereof. In addition, in some examples, the at least one die sensor may comprise a nozzle sensor for each nozzle. In these examples, the signal control logic may suppress transmission of the first set of signals during sensing of nozzle characteristics.

Figure 4:
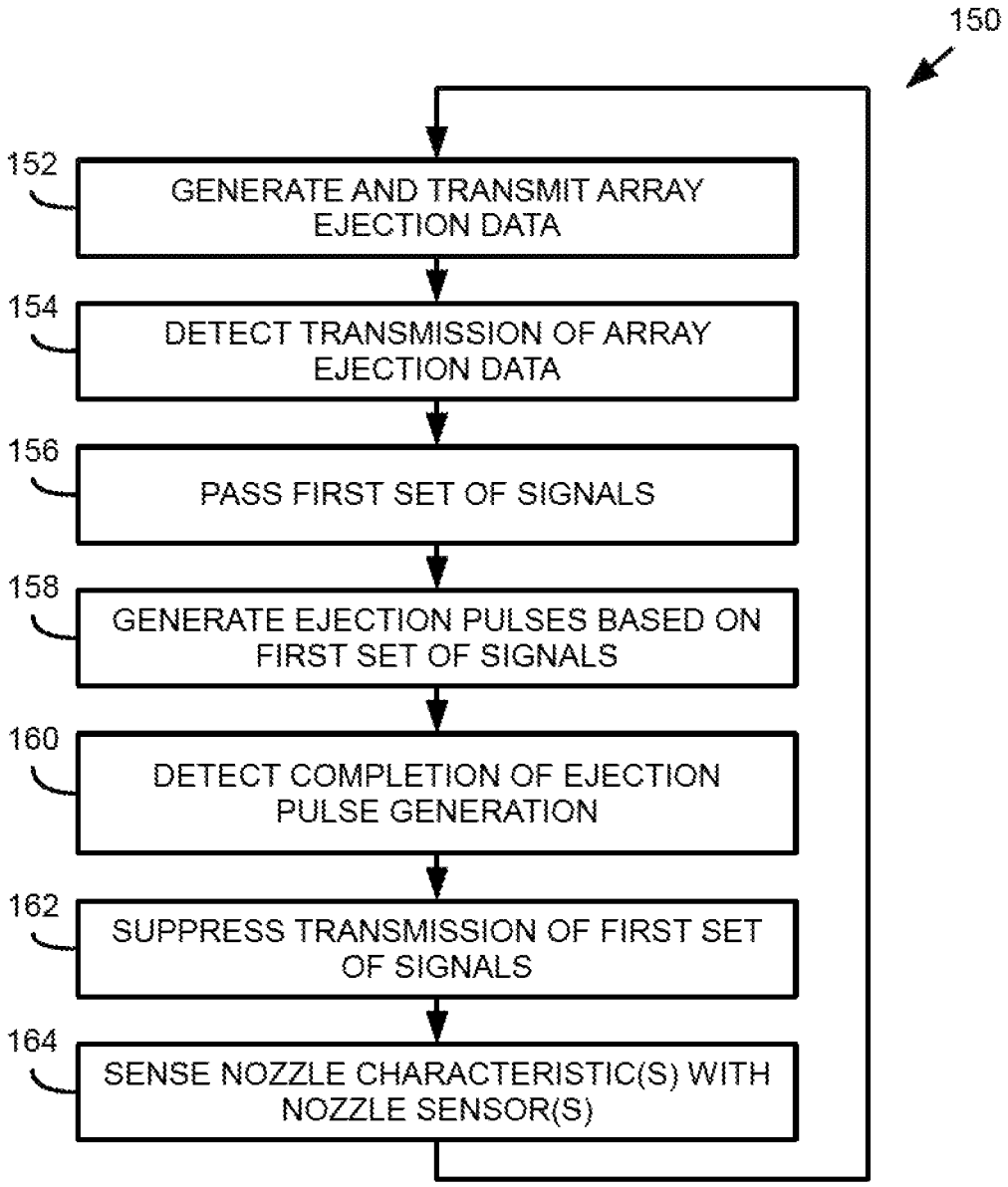
FIG. 4 is a flowchart that illustrates an example sequence of operations that may be performed by an example fluid ejection die.

FIG. 4 provides a flowchart 150 that illustrates a sequence of operations that may be performed by an example fluid ejection die. As shown, the fluid ejection die may generate and transmit a respective array ejection data group (block 152). As discussed previously, the array ejection data group may be generated by ejection data logic based at least in part on ejection data and an ejection clock. Transmission of the array ejection data group may be detected (block 154). In some example fluid ejection dies, transmission of array ejection data may be detected signal control logic. For example, a control latch may be connected to ejection data logic to detect transmission of array ejection data therefrom.

In response to detecting transmission of array ejection data, signal control logic of the fluid ejection die may pass a first set of signals (block 156). In some examples, passing of the first set of signals may comprise the signal control logic passing the first set of signals to an array shift register. In some examples, passing the first set of signals may comprise passing at least an ejection clock. The fluid ejection die may generate ejection pulses based on at least some signals of the first set of signals (block 158). As discussed previously, ejection pulses may cause actuation of fluid ejectors to eject fluid drops via the nozzles. For example, the first set of signals may include at least an ejection clock and array ejection data, and ejection pulses may be generated for fluid ejectors of nozzles that are to be actuated according to the array ejection data, where timing of generation of such pulses (and the corresponding ejection based thereon) may be based on the ejection clock.

The signal control logic may detect completion of ejection pulse generation (block 160). As will be appreciated, completion of ejection pulse generation for respective array ejection data may also correspond to completion of fluid ejection. In some examples, detection of completion of ejection pulse generation may be detected by the signal control logic by detecting exiting of the array ejection data group from an array shift register. In some examples, reset logic of the signal control logic may detect exiting of the array ejection data group from the array shift register.

In response to detecting completion of the ejection pulse generation, signal control logic may suppress transmission of the first set of signals (block 162). When transmission of the first set of signals are suppressed, the fluid ejection die may sense at least one nozzle characteristic of at least one nozzle of the array of nozzles with the respective nozzle sensors (block 164). After fluid ejection and nozzle sensing based on the respective array ejection data group, the operations may be repeated for a next array ejection data group (blocks 152-164).

Figure 5:
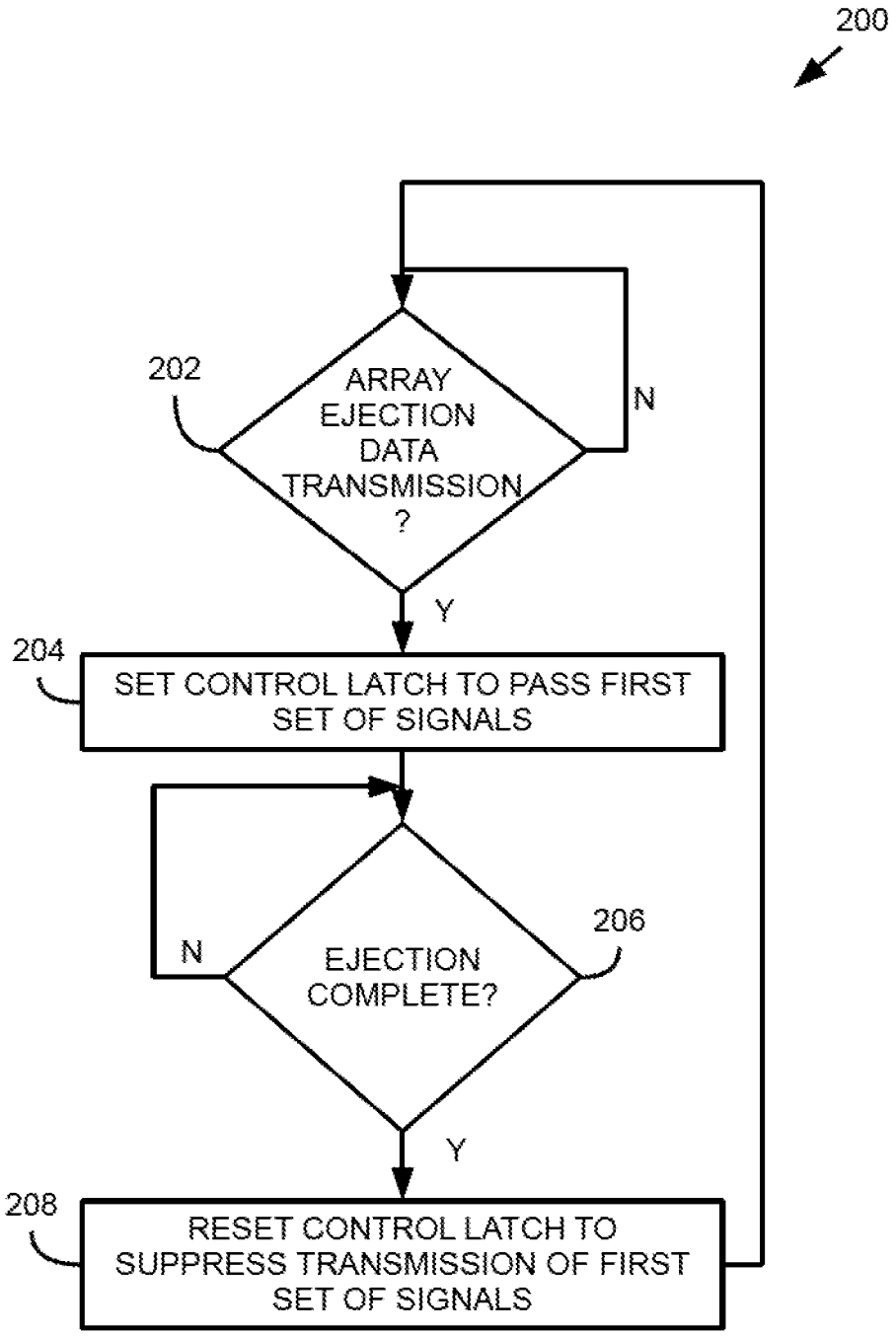
FIG. 5 is a flowchart that illustrates an example sequence of operations that may be performed by an example fluid ejection die.

FIG. 5 provides a flowchart 200 that illustrates a sequence of operations that may be performed by an example fluid ejection die. As discussed, signal control logic of an example fluid ejection die may be connected to ejection data logic to thereby monitor and detect transmission of array ejection data (block 202). If array ejection data transmission is not detected ("N" branch of block 202), the signal control logic may continue monitoring for detection thereof. In response to detecting transmission of an array ejection data group ("Y" branch of block 202), a control latch of the signal control logic may be set such that a first set of signals may be passed (block 204). As discussed in previous examples, setting of the control latch may cause the first set of signals to be transmitted to an array shift register connected to nozzles of the fluid ejection die. For example, the control latch may be connected between an ejection clock and an array shift register, such that the ejection clock may be passed to the array shift register when the control latch is set, and the ejection clock may not be passed to the array shift register (i.e., the ejection clock may be suppressed) when the control latch is reset.

After setting the control latch to pass the first set of signals, the signal control logic may monitor the fluid ejection die to determine if fluid ejection is complete (block 206). During fluid ejection operation, the signal control logic may continue monitoring ("N" branch of block 206). In response to detecting completion of ejection for the array ejection data group ("Y" branch of block 206), the control latch resets to thereby suppress transmission of the first set of signals (block 208), and the operations may be repeated (blocks 202-208).

Figure 6:
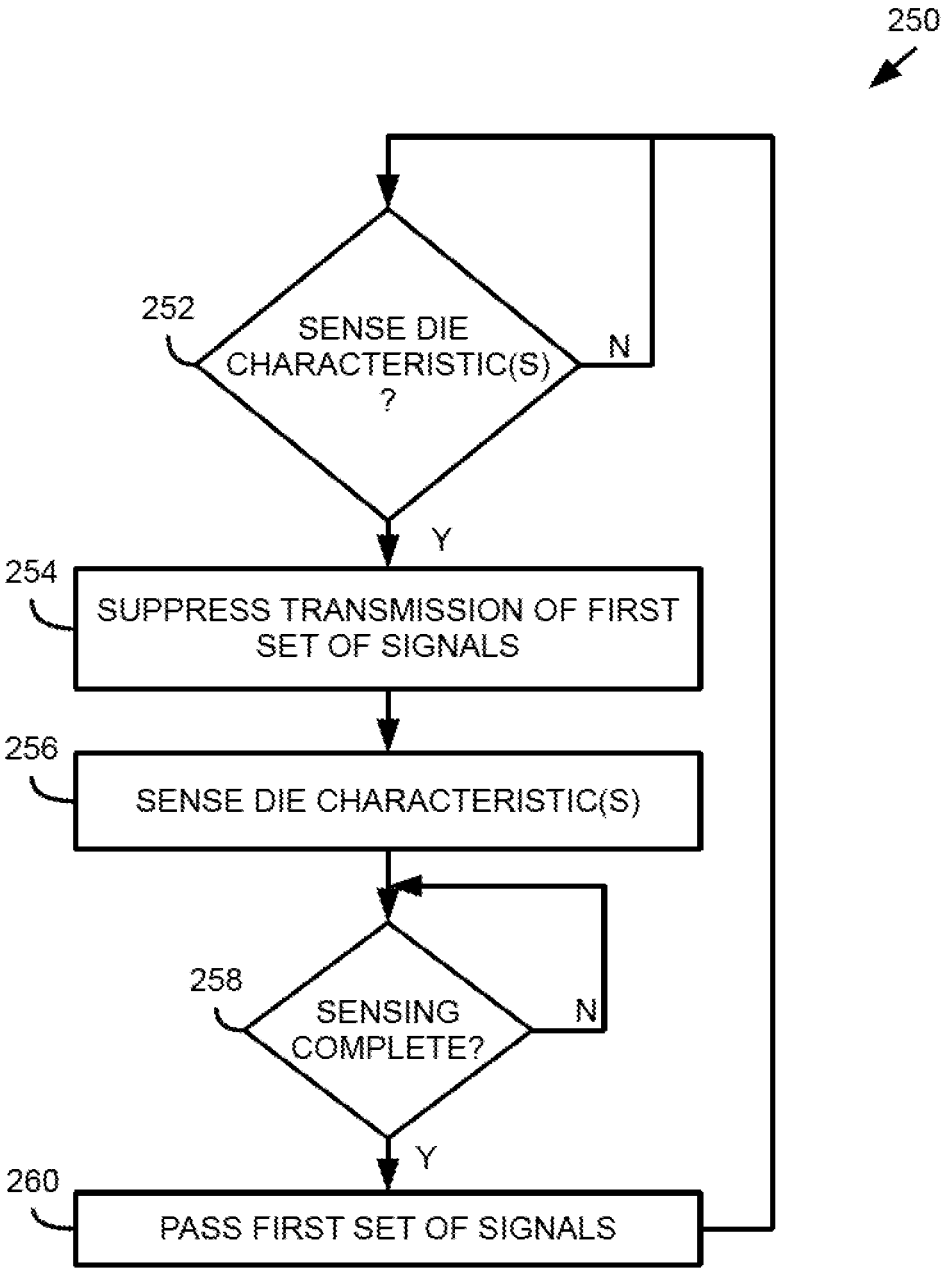
FIG. 6 is a flowchart that illustrates an example sequence of operations that may be performed by an example fluid ejection die.

FIG. 6 provides a flowchart 250 that illustrates an example sequence of operations that may be performed by an example fluid ejection die and/or signal control logic thereof. In some examples, in response to sensing die characteristics for the fluid ejection die ("Y" branch of block 252), signal control logic may suppress transmission of a first set of signals for the fluid ejection die (block 254), and at least one die characteristic associated with the fluid ejection die may be sensed with at least one die sensor of the fluid ejection die (block 256). As will be appreciated, when not sensing die characteristics ("N" branch of block 252), examples may continue monitoring to determine when sensing of die characteristics is to be performed. Examples may monitor to determine when the sensing of the at least one die characteristic is completed (block 258). In response to completing sensing of the at least one die characteristic ("Y" branch of block 258), the signal control logic may pass the first set of signals for the fluid ejection die (block 260). As will be appreciated, during sensing of the at least one die characteristic ("N" branch of block 258), examples may continue monitoring to determine when the sensing is complete. Furthermore, it will be appreciated that the example process and operations thereof may be repeated (blocks 250-260) during operation of the fluid ejection die.

Accordingly, examples provided herein may provide a fluid ejection die including signal control logic. The signal control logic may selectively pass or suppress transmission of signals during operation of the fluid ejection die. In some examples, the signal control logic may selectively pass or suppress transmission of signals during sensing of die characteristics. In particular, the signal control logic may pass a first set of signals for the fluid ejection die when the fluid ejection die is to eject fluid drops via nozzles thereof, and the signal control logic may suppress the first set of signals for the fluid ejection die when the fluid ejection die is to detect die characteristics and/or nozzle characteristics of nozzles thereof. Accordingly, signal control logic, as described herein may thereby reduce interference and/or reduce occurrences of electrical damage to die and/or nozzle sensors and/or sense circuits during sensing of die and/or nozzle characteristics by suppressing the first set of signals.

The preceding description has been presented to illustrate and describe examples of the principles described. This description is not intended to be exhaustive or to limit these principles to any precise form disclosed. Many modifications and variations are possible in light of the description. In addition, while various examples are described herein, elements and/or combinations of elements may be combined and/or removed for various examples contemplated hereby. For example, the example operations provided herein in the flowcharts of FIGS. 3-6 may be performed sequentially, concurrently, or in a different order. Moreover, some example operations of the flowcharts may be added to other flowcharts, and/or some example operations may be removed from flowcharts. In addition, the components illustrated in the examples of FIGS. 1A-2 may be added and/or removed from any of the other figures. Therefore, the foregoing examples provided in the figures and described herein should not be construed as limiting of the scope of the disclosure, which is defined in the Claims.

The invention claimed is:

1. A fluid ejection die comprising:

an array of nozzles, each respective nozzle of the array including a respective fluid ejector to eject fluid;

at least one die sensor to sense a die characteristic associated with the fluid ejection die; and signal control logic to suppress transmission of a first set of signals for the fluid ejection die responsive to completion of an ejection pulse generation, transmission of the first set of signals being suppressed during sensing of die characteristics with the at least one die sensor.

2. The fluid ejection die of claim 1, wherein the signal control logic is further to pass the first set of signals during generation of ejection pulses for the array of nozzles to eject fluid with the respective fluid ejectors.

3. The fluid ejection die of claim 1, wherein the first set of signals include array ejection data corresponding to each respective nozzle of the array and an ejection clock, and the fluid ejection die further comprises:

ejection data logic to generate array ejection data, wherein the signal control logic comprises:

a control latch coupled to the ejection data logic, and a control gate coupled between the control latch and the array of nozzles.

4. The fluid ejection die of claim 1, wherein the at least one die sensor comprises a respective nozzle sensor for each nozzle of the array of nozzles, and the fluid ejection die further comprising:

for each respective nozzle sensor, a respective sense circuit coupled to the respective nozzle sensor, each respective sense circuit to sense nozzle characteristics of the respective nozzle.

5. The fluid ejection die of claim 1, wherein the at least one die sensor comprises a respective nozzle sensor for each nozzle of the array of nozzles, and wherein the signal control logic to suppress transmission of the first set of signals for the fluid ejection die during sensing of die characteristics with the at least one die sensor comprises:

the signal control logic to suppress transmission of the first set of signals for the fluid ejection die during sensing of nozzle characteristics with the respective nozzle sensor of each respective nozzle of the array of nozzles.

6. The fluid ejection die of claim 1, wherein the first set of signals include array ejection data corresponding to each respective nozzle of the array and an ejection clock, and the fluid ejection die further comprises:

an array shift register coupled to the array of nozzles, the array shift register to receive the first set of signals, and the array shift register to generate ejection pulses for the respective fluid ejectors of the array of nozzles based on the ejection signals; and ejection data logic to generate the array ejection data, wherein the signal control logic comprises:

a control latch coupled to the ejection data logic to detect transmission of the array ejection data, and a control gate coupled between the control latch at the array shift register to pass the ejection clock to the array shift register responsive to detection of transmission of the array ejection data.

7. The fluid ejection die of claim 6, wherein the control latch is further to reset in response to completion of the ejection pulse generation such that the control gate suppresses transmission of the ejection clock to the array shift register.

8. The fluid ejection die of claim 1, wherein the at least one die sensor comprises a respective nozzle sensor for each nozzle of the array of nozzles, and each respective nozzle sensor is to sense, for the respective nozzle, at least one of a respective impedance, a respective capacitance, a respective temperature, a respective strain, or any combination thereof.

9. A method for a fluid ejection die comprising:

sensing of at least one die characteristics for a fluid ejection die, with at least one die sensor of the fluid ejection die upon suppressing a first set of signals via a signal control logic; and in response to completing sensing of the at least one die characteristic for the fluid ejection die, passing the first set of signals via the signal control logic wherein the first set of signals include array ejection data for the array of nozzles and an ejection clock, wherein passing the first set of signals via the signal control logic comprises setting a control latch of the signal control logic responsive to detecting transmission of the array ejection data such that the ejection clock is passed to an array shift register, and wherein suppressing transmission of the first set of signals via the signal control logic comprises resetting the control latch responsive to detecting completion of ejection pulse generation by the array shift register to thereby suppress transmission of the ejection clock to the array shift register.

10. The method of claim 9, wherein sensing of the at least one die characteristic for the fluid ejection die comprises:

sensing of nozzle characteristics for nozzles of an array of nozzles of the fluid ejection die.

11. The method of claim 9, wherein the first set of signals include array ejection data for an array of nozzles of the fluid ejection die and an ejection clock, and the method further comprises:

detecting transmission of the array ejection data ejection data logic of the fluid ejection die with the signal control logic, wherein passing the first set of signals via the signal control logic comprises passing the ejection data and the ejection clock to an array shift register of the fluid ejection die.

12. A fluid ejection die comprising:

an array of nozzles;

for each respective nozzle of the array of nozzles, a respective fluid ejector to eject fluid via the nozzle;

for each respective nozzle of the array of nozzles, a respective nozzle sensor;

for each respective nozzle, a respective sense circuit connected to the respective nozzle sensor, each respective sense circuit to sense a respective nozzle characteristic of the respective nozzle;

an array shift register to receive array ejection data and an ejection clock, and the array shift register to generate ejection pulses for respective nozzles of the array of nozzles based at least in part on the array ejection data and the ejection clock; and signal control logic coupled to the array shift register to:

pass the ejection clock to the array shift register during generation of ejection pulses for the respective nozzles of the array of nozzles, and suppress transmission of at least the ejection clock responsive to completing ejection pulse generation, transmission of the ejection clock being suppressed during operation of the respective nozzle sensors to sense the at least one nozzle characteristic for the respective nozzles.

13. The fluid ejection die of claim 12, wherein the signal control logic comprises:

a control latch to set in response to transmission of array ejection data to the array shift register, and the control latch to reset in response to completion of generation of the ejection pulses; and a control gate to pass the ejection clock to the array shift register when the control latch is set, and the control gate to suppress transmission of the ejection clock to the array shift register when the control latch is reset.

14. The fluid ejection die of claim 12, wherein the signal control logic is further to:

pass the ejection clock to the array shift register when transmission of the array ejection data to the array shift register is detected; and suppress transmission of the ejection clock after completion of generation of the ejection pulses is detected.

* * * * *